US007614921B2

(12) United States Patent
Sikora

(10) Patent No.: US 7,614,921 B2
(45) Date of Patent: Nov. 10, 2009

(54) BATTERY POST ELECTRICAL TERMINAL FOR ELECTRICALLY COUPLING AN ELECTRICAL CONDUCTOR WITH THE BATTERY POST OF A BATTERY

(75) Inventor: Ken Sikora, Fort Wayne, IN (US)

(73) Assignee: Group Dekko, Inc., Kendallville, IN (US)

( * ) Notice: Subject to any disclaimer, the term of this patent is extended or adjusted under 35 U.S.C. 154(b) by 0 days.

(21) Appl. No.: 12/115,144

(22) Filed: May 5, 2008

(65) Prior Publication Data

US 2008/0274653 A1 Nov. 6, 2008

Related U.S. Application Data

(60) Provisional application No. 60/915,951, filed on May 4, 2007.

(51) Int. Cl.
*H01R 11/01* (2006.01)

(52) U.S. Cl. ..... 439/756; 439/726

(58) Field of Classification Search ..... 439/754, 439/756, 757, 759, 726, 761, 763, 764, 766, 439/770; D13/24, 119, 120
See application file for complete search history.

(56) References Cited

U.S. PATENT DOCUMENTS 3,568,138 A * 3/1971 Bakker ..... 439/762
D249,944 S * 10/1978 Smith ..... D13/120
D284,184 S * 6/1986 Carey et al. ..... D13/120
5,556,309 A * 9/1996 Sharpe et al. ..... 439/759
5,672,442 A * 9/1997 Burnett ..... 429/121
5,733,152 A * 3/1998 Freitag ..... 439/763
6,234,849 B1 * 5/2001 Blanche ..... 439/764
6,287,155 B1 * 9/2001 Yakovich ..... 439/772
6,409,553 B1 * 6/2002 Krause et al. ..... 439/757
6,648,701 B2 * 11/2003 Mouissie ..... 439/761
6,764,353 B2 7/2004 Freitag
6,817,908 B2 11/2004 Freitag
6,855,008 B1 2/2005 Freitag et al.
6,932,650 B1 8/2005 Freitag
7,189,122 B2 3/2007 Freitag
2007/0264883 A1 * 11/2007 Freitag ..... 439/764

FOREIGN PATENT DOCUMENTS

WO WO2006096242 IB 9/2006

* cited by examiner

*Primary Examiner*—Hae Moon Hyeon
(74) *Attorney, Agent, or Firm*—Taylor & Aust, P.C.

(57) ABSTRACT

A battery post electrical terminal includes a monolithic component configured for electrically coupling an electrical conductor with a battery post of a battery, the component including two arms and a cross-over section connecting the arms, each arm including a first wall and a second wall extending from the first wall, the first walls being substantially parallel relative to each other, the second walls configured for wrapping at least partly around the battery post of the battery and thereby for electrically coupling the component with the battery post.

16 Claims, 7 Drawing Sheets

BATTERY POST ELECTRICAL TERMINAL FOR ELECTRICALLY COUPLING AN ELECTRICAL CONDUCTOR WITH THE BATTERY POST OF A BATTERY

CROSS REFERENCE TO RELATED APPLICATIONS

This is a non-provisional application based upon U.S. provisional patent application Ser. No. 60/915,951, entitled "BATTERY POST ELECTRICAL TERMINAL ASSEMBLY", filed May 4, 2007, which is incorporated herein by reference.

BACKGROUND OF THE INVENTION

1. Field of the Invention

The present invention relates to electrical terminals, and, more particularly, to electrical terminals for battery posts.

2. Description of the Related Art

Automobiles, for instance, carry their own source of electrical power, a battery. That battery then supplies, via electrical conductors, power to various aspects of the vehicle. The battery has an electrical post which couples with an electrical terminal. A disadvantage exists, however, in having to use tools to connect the electrical terminal with the battery post.

What is needed in the art is a battery post electrical terminal assembly which simply, easily, and reliably provides for mechanical and electrical coupling with a battery post using an interference fit without tools.

SUMMARY OF THE INVENTION

The present invention provides a battery post electrical terminal assembly which simply, easily, and reliably provides for mechanical and electrical coupling with a battery post using an interference fit without tools.

The invention in one form is directed to a battery post electrical terminal which includes a monolithic component configured for electrically coupling an electrical conductor with a battery post of a battery, the component including two arms and a cross-over section connecting the arms, each arm including a first wall and a second wall extending from the first wall, the first walls being substantially parallel relative to each other, the second walls configured for wrapping at least partly around the battery post of the battery and thereby for electrically coupling the component with the battery post.

The invention in another form is directed to a method of mounting a battery post electrical terminal to a battery post of a battery, the method including the steps of providing, coupling, and wrapping. The providing step provides that the battery post electrical terminal includes a monolithic component including two arms and a cross-over section connecting the arms, each arm including a first wall and a second wall extending from the first wall, the first walls being substantially parallel relative to each other. The coupling step electrically couples an electrical conductor with the battery post using the monolithic component. The wrapping step wraps the second walls at least partly around the battery post and thereby electrically couples the component with the battery post.

An advantage of the present invention is that it provides a friction fit design for coupling an electrical terminal with a battery post.

Another advantage is that the battery post electrical terminal assembly is easy to assemble and disassemble.

Yet another advantage is that the battery post electrical terminal assembly can be assembled on a battery post without having to use tools.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
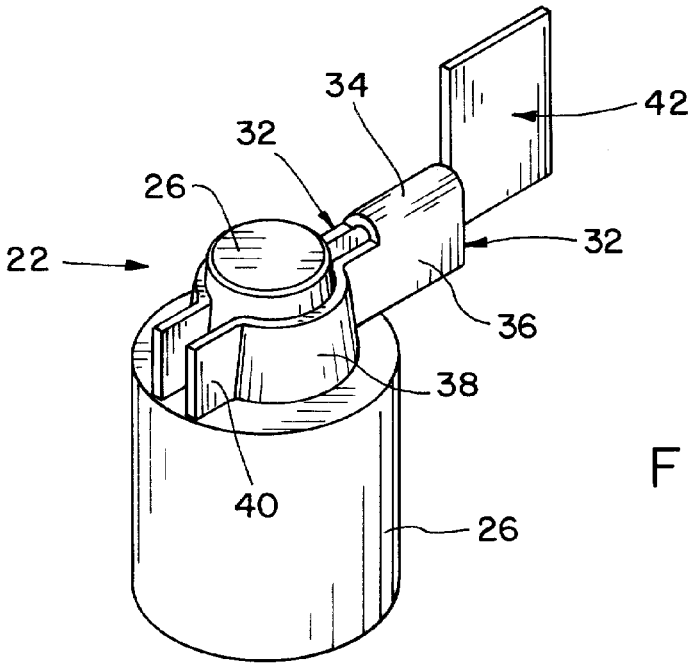
FIG. 1 is a perspective view of the battery post electrical terminal according to the present invention mounted on a battery post.
Figure 2:
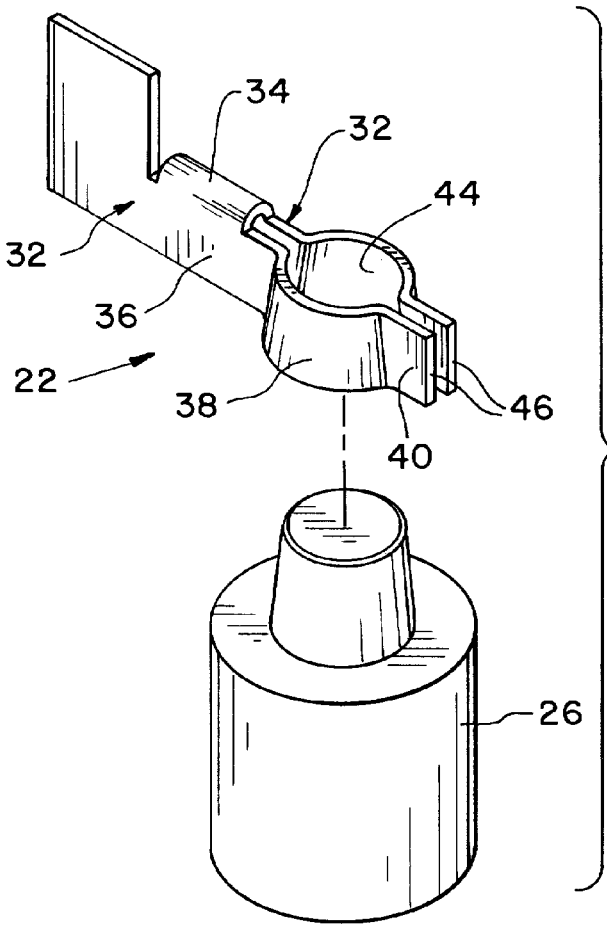
FIG. 2 is a perspective view of the battery post electrical terminal of FIG. 1 dismounted from the battery post.
Figure 3:
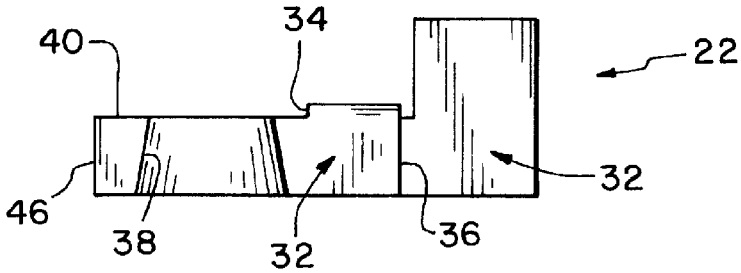
FIG. 3 is a side elevation view of the battery post electrical terminal of FIG. 1.
Figure 4:
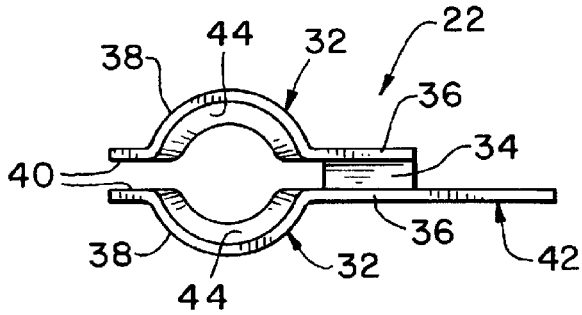
FIG. 4 is a bottom plan view of the battery post electrical terminal of FIG. 1.

Referring now to the drawings, and more particularly to FIGS. 1-4 and 14, there is shown an electrical system 20 including a battery post electrical terminal 22, an electrical conductor 24 (in the form of, for example, cabling or wiring) coupled with terminal 22, a battery post 26 of a battery 28 (battery post 26 being coupled with terminal 22), and an electrical load 30. Battery post electrical terminal 22 generally includes two arms 32 and a cross-over section 34 connecting arms 32. Terminal 22 electrically couples electrical conductor 24 with battery post 26. Electrical system 20 can be for a self-propelled device such as an automobile, or the like, but is not limited to self-propelled devices.

Terminal 22 includes a monolithic component. "Monolithic" is intended to mean that component is a single piece. It is noted that terminal 22 can be coextensive with component such that terminal 22 is itself monolithic and thus a single-piece device; in this case, terminal 22 is monolithic component 22, as provided in the embodiment of the invention shown in FIGS. 1-4 (as well as in the embodiment of the invention shown in FIGS. 5-6, discussed below). As such, terminal 22 does not include a clip, clamp, or retaining device to hold arms 32 together after terminal 22 is mounted to battery post 26.

Figure 10:
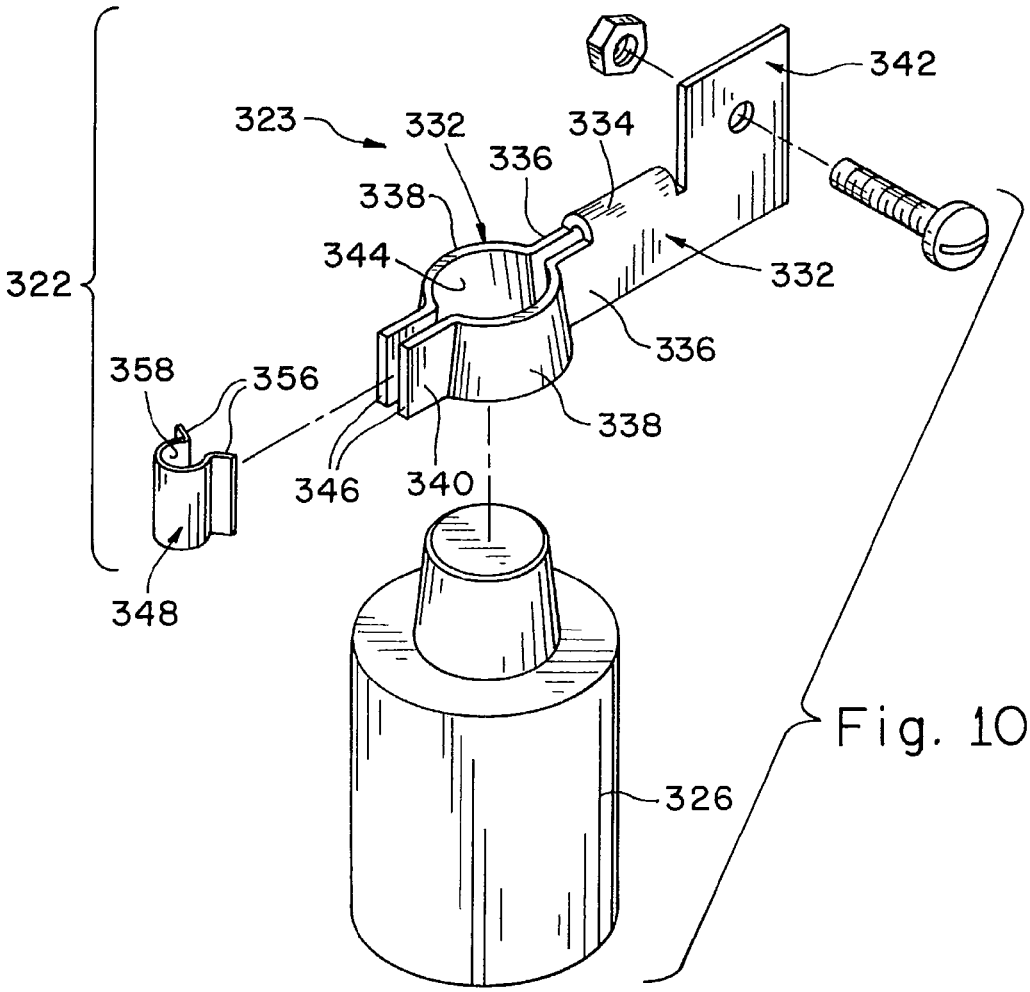
FIG. 10 is an exploded, perspective view of yet another embodiment of the battery post electrical terminal according to the present invention dismounted from the battery post.

Each arm 32 includes a first wall 36 and a second wall 38 extending from first wall 36. First walls 36 are substantially parallel relative to each other. Second walls 38 wrap at least partly around battery post 26 and thereby electrically couple component 22 with battery post 26. Electrical terminal 22 is made of, in whole or in part, electrically conductive material, such as copper. Further, electrical terminal 22 can generally have a longitudinal extent and include an electrical conductor coupling end 42. Electrical conductor coupling end 42 includes one or more features for attaching terminal to electrical conductor 24 in a suitable manner. For example, an electrical conductor 24 can be fastened to conductor coupling end 42 by crimping, folding, using a bolt and nut arrangement for clamping conductor to a flat plate, or otherwise holding electrical conductor 24 to terminal 22. FIG. 10, for instance, shows a nut and bolt arrangement for clamping the electrical conductor to the flat plate of electrical conductor coupling end 342. The electrical conductor could be captured between first walls 236 of FIG. 7. The electrical conductor could be soldered to the terminal of the present invention. These examples, however, are not intended to be limiting.

Arms 32 are resilient and resiliently receive battery post 26 when terminal 22 is pressed down on battery post 26. Further, first walls 36 are connected together by cross-over section 34. Cross-over section 34 can be the only portion of terminal 22 which serves to connect arms 32 together (as shown in FIGS. 1-6 for instance). As shown in FIGS. 1-4 (and shown in FIGS. 7-13 in the corresponding cross-over section), cross-over section 34 can have a U-shape; thus, cross-over section 34 forms a smooth, U-shaped curve between flat and parallel first walls 36, first walls 36 being positioned proximate and adjacent one another with little space therebetween.

Each second wall 38 forms a shape which generally mates with battery post 26. Second walls 38 mirror each other in shape and together form a mounting hole 44 for receiving battery post 26. As shown in the drawings, second walls 38 can each form part of a circle and together form at least a substantial portion of a complete circle. Mounting hole 44 formed by second walls 38 can have a tapering diameter which decreases as hole 44 runs from a leading edge of second wall to a trailing edge of second walls. "Leading" and "trailing" are made in reference to the insertion of battery post 26 in mounting hole 44, the leading edge thus being the first edge which is passed by battery post 26 when battery post 26 is inserted in mounting hole 44. This tapering thus serves to ease insertion of post 26 into hole 44.

Each arm 32 can further include a third wall 40 extending from a corresponding second wall 38 along the same arm 32. Third walls 40 can form terminating ends 46 of each respective arm 32 and thus of component. Third walls 40 can be substantially parallel relative to one another and to first walls 36. As such, first and third walls 36, 40 can be substantially parallel to the longitudinal axis of component 22.

As indicated above, the embodiment of the invention shown in FIGS. 1-4 (as well as the embodiment of the present invention shown in FIGS. 5-6) show terminal 22 being a single-piece device without a clip, clamp, or retaining device used to hold arms of component to battery post. In this case, resilient arms 32 alone hold terminal 22 to battery post 26 and thereby securely mechanically connect component 22 to post 26.

In use, the single-piece terminal 22 (which is, as stated above, component 22) of FIGS. 1-4 involves aligning battery post 26 with mounting hole 44 formed by second walls 38. In so doing, battery post 26 is placed adjacent the leading edge of second walls 38. Component 22 is pressed down onto battery post 26 until component 22 can be pressed no further due to the gripping action of arms 32 and/or because battery 28 or battery post 26 includes a wall that halts the downward travel of terminal 22. In pressing terminal 22 down onto post, arms 32 resiliently spring outwardly as necessary to accommodate post 26 and second walls 38 grip post 26 in a secure manner so as to prevent accidental detachment of terminal 22 from post 26. As such, terminal 22 mechanically and electrically couples to post 26, thereby providing electrical connection between conductor 24 and battery 28. It is noted that directional terminology such as "up" and "down" are made herein in reference to a battery post 26 seated on a horizontal plane and extending in a vertical direction. It is understood that in use battery post 26 and battery terminal 22 may be angled to any degree from the horizontal plane.

Figure 5:
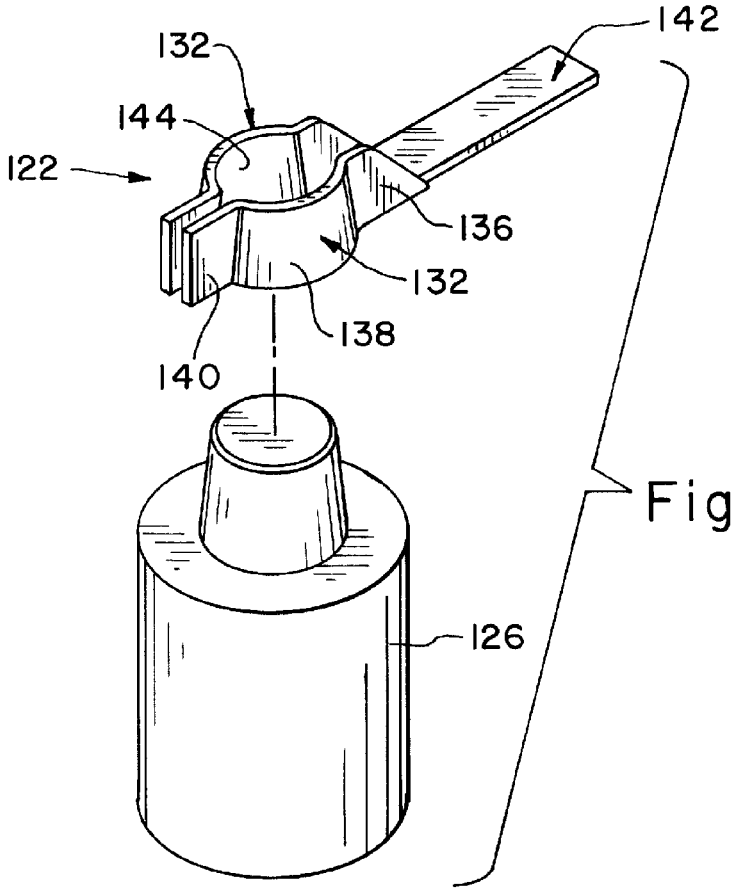
FIG. 5 is a perspective view of another embodiment of the battery post electrical terminal according to the present invention dismounted from the battery post.
Figure 6:
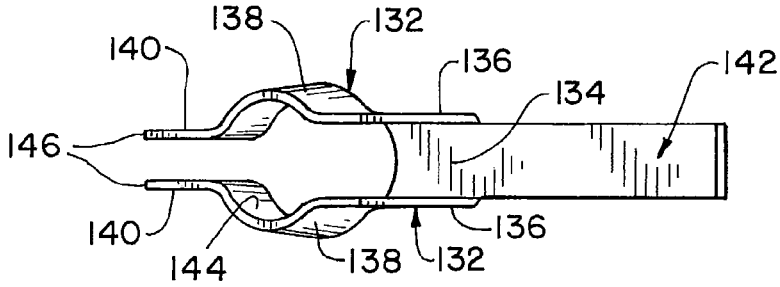
FIG. 6 is a perspective view of the battery post electrical terminal of FIG. 5.

FIGS. 5-6 show another embodiment of the present invention. Reference characters of the embodiment shown in FIGS. 5-6 corresponding to reference characters of the embodiment shown in FIGS. 1-4 are raised by 100. Like terminal 22, terminal 122 is a monolithic device and thus itself serves to provide sufficient mechanical and electrical connection between itself and post 126. It is noted that in FIGS. 5-6 cross-over section 134 is a flat plate which is configured for coupling, in a suitable manner, with an electrical conductor at a conductor coupling end 142 of terminal 122 (a nut and bolt arrangement, for instance, can be used to couple the flat plate of end 142 with the conductor). As a flat plate, cross-over section 134 substantially spaces apart first walls 136 from each other. Cross-over section 134 thus attaches to bottom edges of first walls 136. It is further noted that first walls 136, while being substantially parallel, can converge slightly towards one another (move inwardly slightly relatively to one another) as first walls 136 extend longitudinally toward second walls 138. Terminal 122 is mounted to post 126 similar to the mounting of terminal 22 to post 26, as described above.

Referring now to FIGS. 7-13, while the terminal of the present invention includes a monolithic component, the terminal can be a two-piece device, as indicated below and provided in the embodiments of the invention shown in FIGS. 7-13. One piece is the monolithic component (which includes the arms), and the other piece is a clip, clamp, or retaining device for holding the two arms of the monolithic component together in a secure fashion after the monolithic component is mounted to the battery post. It is understood that the terms clip, clamp, or retaining device can be used interchangeably with respect to this additional piece which serves to hold the arms together after the battery post is inserted into the mounting hole formed by the second walls of the arms. The clamp (i.e., clamps 248, 348, 448, 548, 648) and the arms thus cooperatively mechanically couple the component (i.e., components 223, 323, 423, 523, 623) with the battery post. As such, the clamp provides a tight and secure mechanical connection between the component and the battery post. It is noted that since the terminals and the monolithic components respectively shown in FIGS. 7-13 are not coextensive with each other (i.e., are individual parts), the terminals in FIGS. 7-13 are raised by multiples of 100 (starting with 222 in FIGS. 7-9) but the monolithic components in FIGS. 7-13 are referenced from a base of 23 using multiples of 100 (starting with 223 in FIGS. 7-9).

Figure 7:
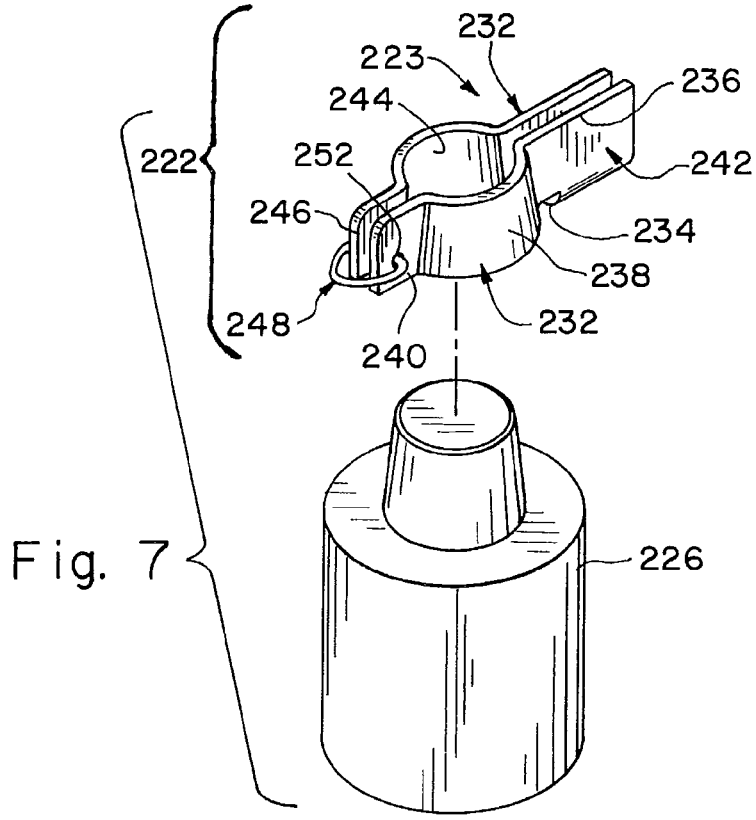
FIG. 7 is a perspective view of yet another embodiment of the battery post electrical terminal according to the present invention dismounted from the battery post.
Figure 8:
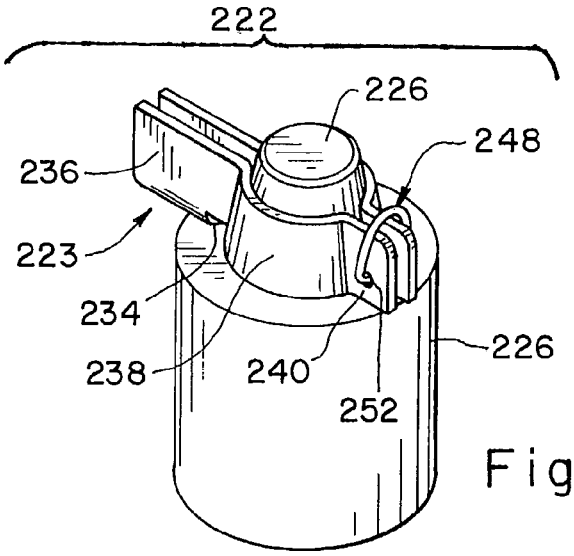
FIG. 8 is a perspective view of the battery post electrical terminal of FIG. 7 mounted on the battery post.
Figure 9:
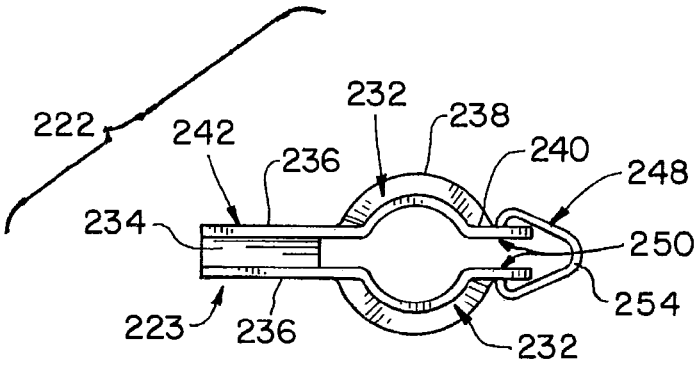
FIG. 9 is a top plan view of the battery post electrical terminal of FIG. 7

Regarding the embodiment of the present invention shown in FIGS. 7-9, reference characters of the embodiment shown in FIGS. 7-9 corresponding to reference characters of the embodiment shown in FIGS. 1-4 are raised by 200. Terminal 222 thus includes component 223 and a clamp 248 which can be called a swing clamp. Swing clamp 248 can be formed as a sturdy metal wire 248 and can include two opposing ends 250. Each end 250 can be received in a hole 252 defined in each third wall 240; each end 250 can terminate in the corresponding hole 250 252. Thus, swing clamp 248 pivots in holes 252 between a clamped position and an unclamped position, holes 252 thus forming a pivot or rotation axis extending therethrough. That is, swing clamp 248 occupies an unclamped position while inserting battery post 226 in mounting hole 244 and before component 223 is seated and on battery post 226. After seating component 223 on post 226, swing clamp 248 can be pivoted to a clamped position. To occupy the clamped position, an apex 254 of clamp 248 frictionally engages a portion of both third walls 240. Moving clamp 248 between an unclamped position to a clamped position, and vice versa, can be done with finger-strength. FIG. 7 (and FIG. 9) shows clamp 248 in the unclamped position, while FIG. 8 shows clamp 248 in the clamped position. It is noted that first walls 236, while being substantially parallel, can converge slightly towards one another (move inwardly slightly relatively to one another) as first walls 236 extend longitudinally toward second walls 238 (it is noted that this possibility is true for all embodiments of the present invention).

Additional embodiments of the clamp which cooperates with the arms to securely mechanically couple the monolithic component with battery post are shown in FIGS. 10-13. The clamps of each of these additional embodiments can be made of spring steel, for instance. Further, these clamps form a snap-fit arrangement with the monolithic component and can be coupled and decoupled with monolithic component by the end-user.

FIG. 10 thus shows yet another embodiment of the present invention. Reference characters of the embodiment shown in FIG. 10 corresponding to reference characters of the embodiment shown in FIGS. 1-4 are raised by 300. Terminal 322 thus includes component 323 and clamp 348. FIG. 10 shows clamp 348 as a resilient retainer clip which includes skids 356 and a catch portion 358. Retainer clip slips onto the terminating ends 346 of third walls 340 and thereby holds arms 332 together. It is noted that the embodiment of component 323 is substantially identical to terminal 22 of FIGS. 1-4 except that the flat plate forming conductor coupling end 342 is connected to the other first arm 336 (as compared to the embodiment shown in FIGS. 1-4) and that the flat plate of conductor coupling end 342 is shown as having a nut and bolt arrangement for coupling with an electrical conductor.

Figure 11:
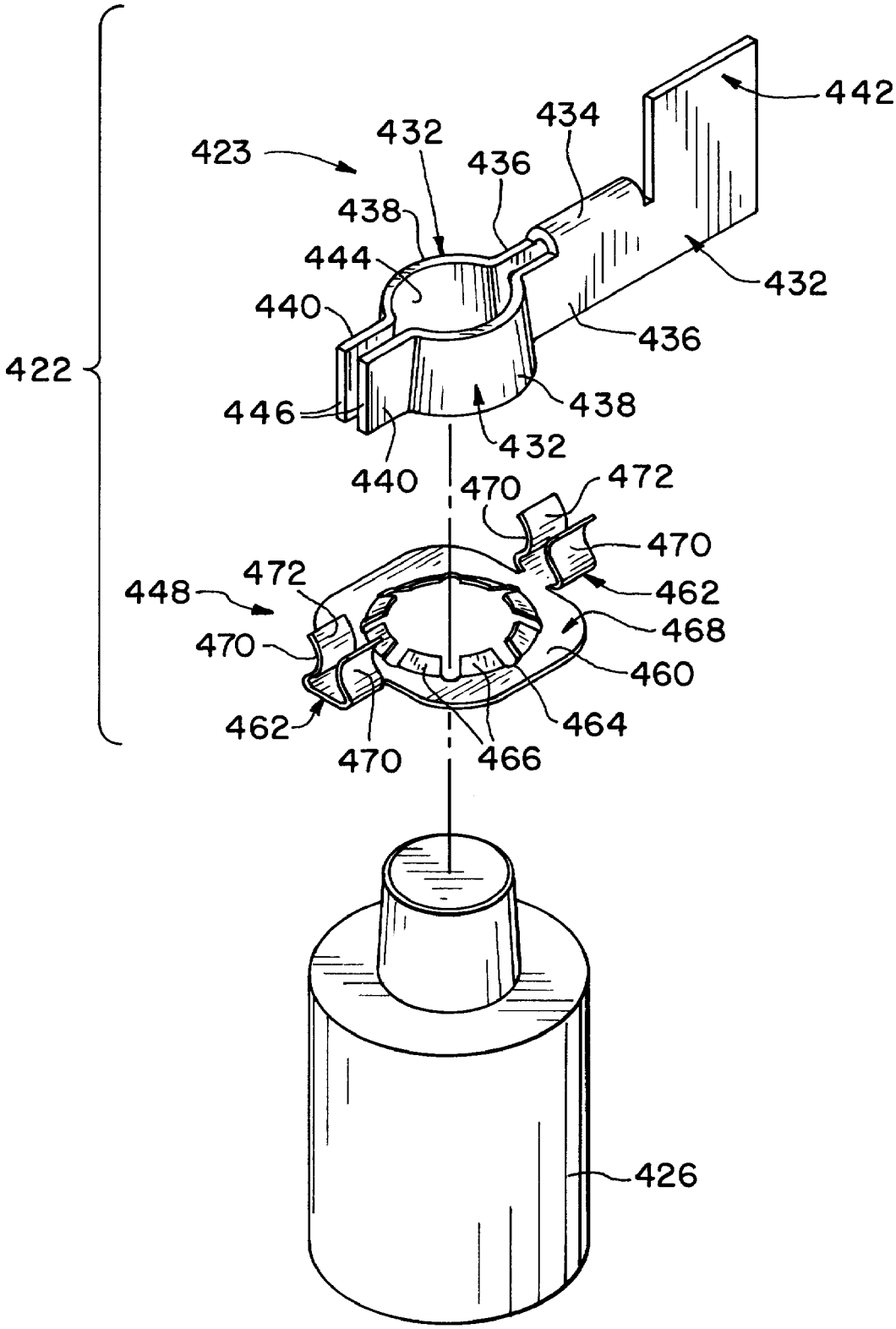
FIG. 11 is an exploded, perspective view of yet another embodiment of the battery post electrical terminal according to the present invention dismounted from the battery post.

FIG. 11 shows yet another embodiment of the present invention. Reference characters of the embodiment shown in FIG. 11 corresponding to reference characters of the embodiment shown in FIGS. 1-4 are raised by 400. Terminal 422 thus includes component 423 and clamp 448. It is noted that the embodiment of component 423 is substantially identical to terminal 22 of FIGS. 1-4 except that the flat plate forming conductor coupling end 442 is connected to the other first arm 436 (as compared to the embodiment shown in FIGS. 1-4). Further, FIG. 11 shows clamp 448 as a different type of retainer clip 448. Here, retainer clip 448 can be a monolithic device which includes a plate 460 and two opposing and upwardly extending, substantially identical, sub-clamps 462. Retainer clip 448 may or may not be electrically conductive. Plate 460 defines a mounting through-hole 464 for receiving and mounting retainer clip 448 to battery post 426, post 426 being inserted through mounting hole 464 as retainer 448 is pushed down onto post 426. Mounting hole 464 can be centered on flat plate 460, as shown in FIG. 11. Plate 460 forms several fingers 466 which frictionally engage battery post 426 and thereby mechanically, and possibly electrically, couple retainer 448 with battery post 426. Fingers 466 are spaced apart from one another, arranged in a circle relative to one another, and project into mounting hole 464 (that is, fingers 466 project inwardly relative to mounting hole 464). Stated another way, fingers 466 extend radially inwardly and form teeth or spring teeth which can dig into post 426 when retainer 448 is pushed down onto post 426. It is noted that mounting hole 464 can vary in diameter depending upon the extent to which battery post 426 displaces or deforms fingers 466 when retainer 448 is mounted to post 426, the greatest diameter being if each finger 466 deflects vertically or perpendicularly to plate 460 when mounting hole 464 receives post 426. However, the diameter of the mounting hole 464 should be less than this greatest diameter because the fingers 466 should deflect only partly from the horizontal plane 468 formed by plate 460 (when post 426 is inserted into mounting hole 464), not completely to the vertical position. Thus, fingers 466 project from plate 460 toward battery post 426, fingers 466 being angled relative to plane 468 of plate 460 and thereby securing retainer 448 to battery post 426. Fingers 466 deflect somewhat upwardly or in a direction generally opposing removal of retainer 448 from post 426. As such, fingers 466 help to prevent retainer 448 from accidentally detaching from post 426. Fingers 466 can be deformed by battery post 426 when mounting hole 464 receives post 426. Noted is that fingers 466, in FIG. 11 are shown as already being deflected upwardly, for illustrative purposes. However, before mounting retainer 448 to post 426, fingers 466 may not yet be deflected upwardly but may still lie in plane 468 of plate 460 until post 426 deflects fingers 466 upwardly during insertion of post 426 in mounting hole 464.

Each sub-clamp 462 includes two resilient legs 470 which form skids 472 and hold arms 432 between legs 470. In use, retainer 448 and component 423 can be assembled together and then placed on battery post 426 or separately placed on battery post 426. Either way, mounting hole 444 of component 423 and mounting hole 464 of retainer 448 align with each other so that each receives battery post 426. Fingers 466 can dig into battery post 426 and secure retainer 448 and component 423 against accidental detachment from post 426. Sub-clamps 462 are snap-fittingly engaged with both first walls 436 and both third walls 440. That is, both first walls 436 slip along skids 472 and into the holding portion between legs 470; similarly, both third walls 440 slip along skids 472 and into the holding portion between legs 470 of the other sub-clamp 462. Sub-clamps 462 thus hold arms 432 together and tightly to post 426.

Figure 12:
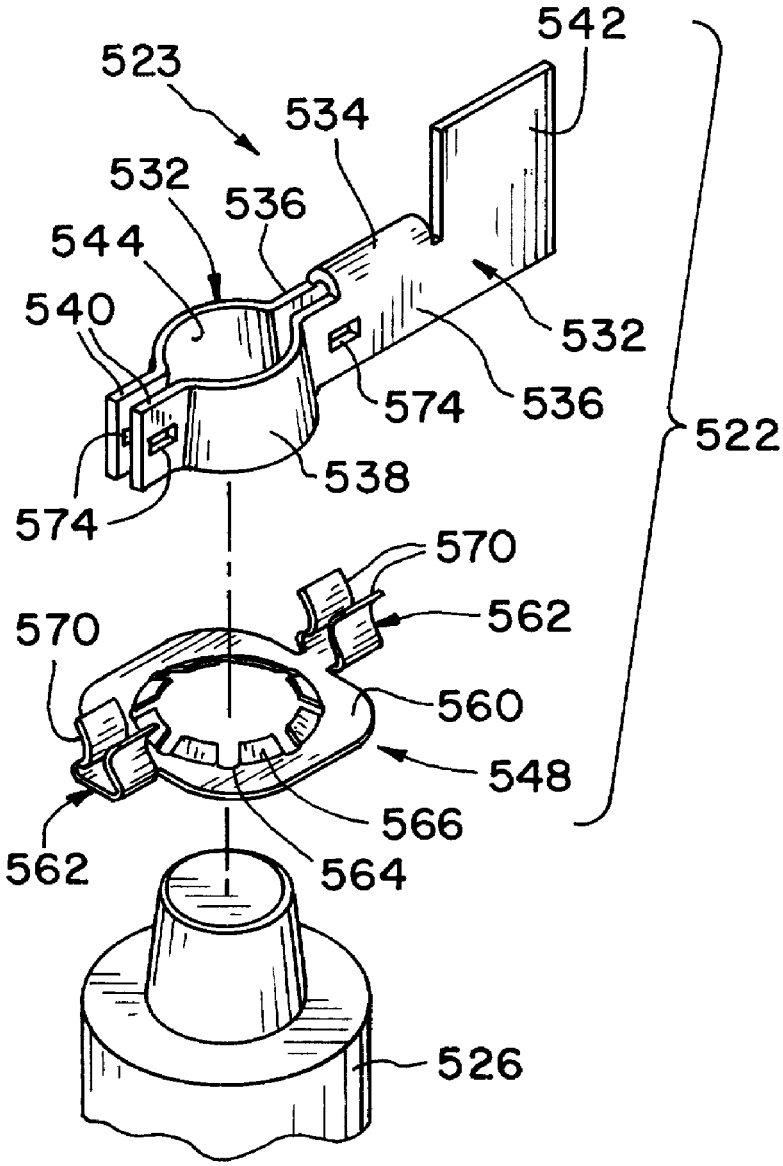
FIG. 12 is an exploded, perspective view of yet another embodiment of the battery post electrical terminal according to the present invention dismounted from the battery post.

FIG. 12 shows yet another embodiment of the present invention. Reference characters of the embodiment shown in FIG. 12 corresponding to reference characters of the embodiment shown in FIGS. 1-4 are raised by 500. Terminal 522 thus includes component 523 and clamp 548. It is noted that the embodiment of component 523 is substantially identical to terminal 22 of FIGS. 1-4 except that the flat plate forming conductor coupling end 542 is connected to the other first arm 536 (as compared to the embodiment shown in FIGS. 1-4). Further, clamp 548 is identical to clamp 448 of FIG. 11. In FIG. 12, however, the primary difference (from terminal 422 of FIG. 11) is that arms 532 include a plurality of retainer holes 574. More specifically, each first arm 536 and each third arm 540 includes a retainer hole 574. Mounting holes 574 oppose each other on first walls 536 (and thus are placed in substantially the same place on each first wall 536), and mounting holes 574 oppose each other on third walls 540 (and thus are placed in substantially the same place on each third wall 540). When component 523 and clamp 548 are assembled together, the inwardly bent portions of legs 570 insert or seat at least partially in retainer holes 574 to provide additional security against detachment of component 523 relative to clamp 548. A snap-fitting engagement is thus formed.

Figure 13:
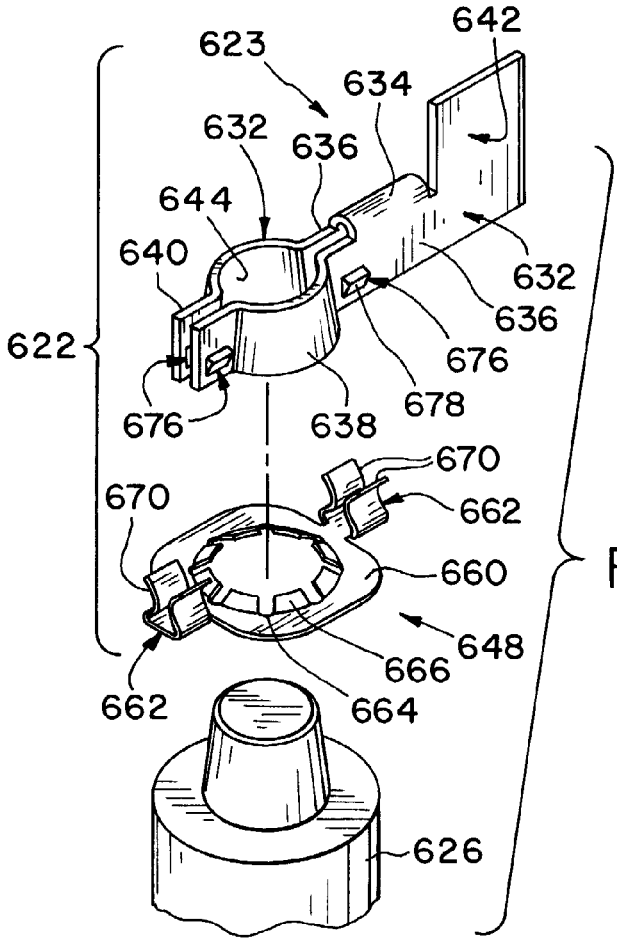
FIG. 13 is an exploded, perspective view of yet another embodiment of the battery post electrical terminal according to the present invention dismounted from the battery post.
Figure 14:
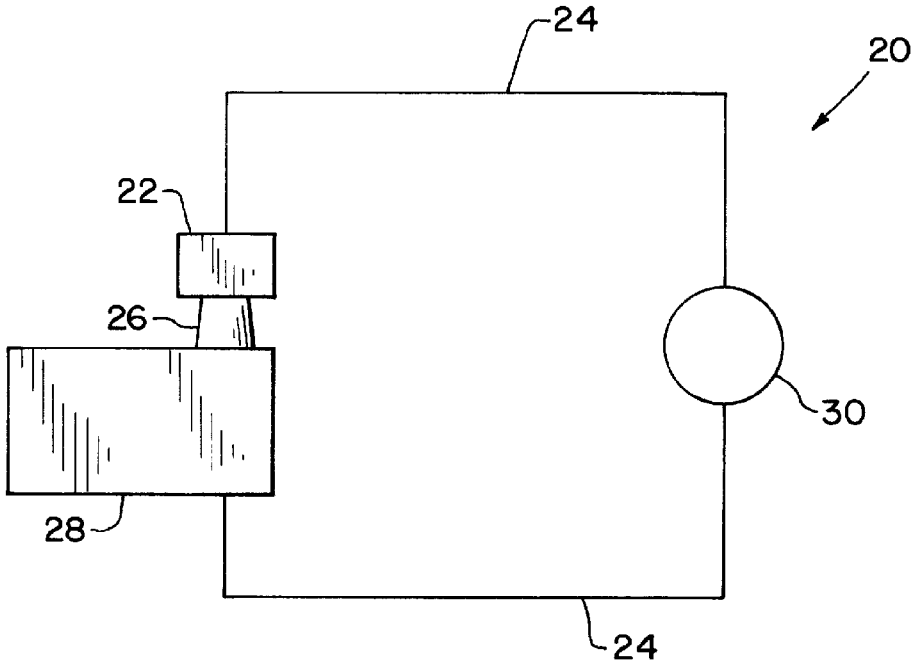
FIG. 14 schematically shows an electrical system including the battery post electrical terminal according to the present invention mounted to a battery post of a battery and coupled with an electrical conductor.

FIG. 13 shows yet another embodiment of the present invention. Reference characters of the embodiment shown in FIG. 13 corresponding to reference characters of the embodiment shown in FIGS. 1-4 are raised by 600. Terminal 622 thus includes component 623 and clamp 648. It is noted that the embodiment of component 623 is substantially identical to terminal 22 of FIGS. 1-4 except that the flat plate forming conductor coupling end 642 is connected to the other first arm 636 (as compared to the embodiment shown in FIGS. 1-4). Further, clamp 648 is identical to clamp 448 of FIG. 11. In FIG. 13, however, the primary difference (from terminal 422 of FIG. 11) is that arms 632 include retainer projections 676. More specifically, each first arm 636 and each third arm 640 includes a retainer projection 676. Retainer projections 676 oppose each other on first walls 636 (and thus are placed in substantially the same place on each first wall 636), and retainer projections 676 oppose each other on third walls 640 (and thus are placed in substantially the same place on each third wall 640). Each retainer projection 676 includes a ramped portion 678 for easily receiving legs 670 of sub-clamps 662. When component 623 and retainer 648 are assembled together, the inwardly bent portions of legs 670 slip along the corresponding ramped portion 678 of retainer projections 676 and then over the end of the ramped portions 678 to snap-fittingly engage retainer projections 676.

The present invention further provides a method of mounting battery post electrical terminal 22 to battery post 26 of battery 28. The method includes the steps of providing, coupling, and wrapping. The providing step provides that battery post electrical terminal 22 includes a monolithic component 22 (or 223, for example) including two arms 32 and cross-over section 34 connecting arms 32, each arm 32 including first wall 36 and second wall 38 extending from first wall 36, first walls 36 being substantially parallel relative to each other. The coupling step electrically couples electrical conductor 24 with battery post 26 using monolithic component 22 (or 223). The wrapping step wraps second walls 38 at least partly around battery post 26 and thereby electrically couples component 22 (or 223) with battery post 26. Battery post electrical terminal 22 can be a monolithic component 22. Arms 32 are resilient, arms 32 resiliently receiving and holding battery post 26 and thereby mechanically connecting component 22 with battery post 22. Second walls 38 mirror each other in shape and together form a mounting hole 44 for receiving battery post 26. Each first wall 36 can be connected together by cross-over section 34 such that cross-over section 34 has a U-shape. Alternatively, each first wall 36 can be connected together by cross-over section 34 such that cross-over section 34 is a flat plate. The method can further include the step of connecting a clamp 248 (or clamps 348, 448, 548, or 648) to arms 232, arms 232 being resilient, second walls 238 mirroring each other in shape and together form a mounting hole 244 receiving battery post 226, clamp 248 (or clamps 348, 448, 548, or 648) and arms 232 cooperatively mechanically coupling component 223 with battery post 226. The method can further include the step of pivoting swing clamp 248 to a clamped position after mounting hole 244 receives battery post 226, swing clamp 248 including two opposing ends 250 and each arm 232 including a third wall 240 extending from a corresponding second wall 238, third walls 240 respectively forming terminating ends 246 of component 223, third walls 240 being substantially parallel relative to one another, each third wall 240 defining a hole 252 therein, each hole 252 receiving a respective end 250 of swing clamp 248.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A battery post electrical terminal, comprising:

a monolithic component configured for electrically coupling an electrical conductor with a battery post of a battery, said component including two arms and a cross-over section connecting said arms, each said arm including a first wall and a second wall extending from said first wall, said first walls being substantially parallel relative to each other, said second walls configured for wrapping at least partly around said battery post of said battery and thereby for electrically coupling said component with said battery post, said second walls together forming a single mounting hole for receiving said battery post.

2. The battery post electrical terminal of claim 1, wherein the battery post electrical terminal is said monolithic component such that the battery post electrical terminal does not include a retaining device to hold said arms together after the battery post electrical terminal is mounted to said battery post.

3. The battery post electrical terminal of claim 2, wherein said arms are resilient, said arms being configured for resiliently receiving and holding said battery post and thereby for mechanically connecting said component with said battery post.

4. The battery post electrical terminal of claim 3, wherein said second walls mirror each other in shape.

5. The battery post electrical terminal of claim 4, wherein each said first wall is connected together by said cross-over section, said cross-over section having a U-shape.

6. The battery post electrical terminal of claim 4, wherein each said first wall is connected together by said cross-over section, said cross-over section being a flat plate.

7. The battery post electrical terminal of claim 1, further comprising a clamp connected to said arms, said arms being resilient, said second walls mirroring each other in shape and together forming a mounting hole for receiving said battery post, said clamp and said arms configured for cooperatively mechanically coupling said component with said battery post.

8. The battery post electrical terminal of claim 7, wherein said clamp is a swing clamp which includes two opposing ends and each said arm includes a third wall extending from a corresponding said second wall, said third walls respectively forming terminating ends of said component, said third walls being substantially parallel relative to one another, each said third wall defining a hole therein, each said hole receiving a respective said end of said swing clamp, said swing clamp configured for pivoting to a clamped position after said mounting hole receives said battery post.

9. A method of mounting a battery post electrical terminal to a battery post of a battery, said method comprising the steps of:

providing that the battery post electrical terminal includes a monolithic component including two arms and a cross-over section connecting said arms, each said arm including a first wall and a second wall extending from said first wall, said first walls being substantially parallel relative to each other;

electrically coupling an electrical conductor with the battery post using said monolithic component; and wrapping said second walls at least partly around the battery post and thereby electrically coupling said component with the battery post, said second walls together forming a single mounting hole which receives said battery post.

10. The method of claim 9, wherein the battery post electrical terminal is said monolithic component such that the battery post electrical terminal does not include a retaining device to hold said arms together after the battery post electrical terminal is mounted to said battery post.

11. The method of claim 10, wherein said arms are resilient, said arms resiliently receiving and holding the battery post and thereby mechanically connecting said component with the battery post.

12. The method of claim 11, wherein said second walls mirror each other in shape.

13. The method of claim 12, wherein each said first wall is connected together by said cross-over section, said cross-over section having a U-shape.

14. The method of claim 12, wherein each said first wall is connected together by said cross-over section, said cross-over section being a flat plate.

15. The method of claim 10, further comprising the step of connecting a clamp to said arms, said arms being resilient, said second walls mirroring each other in shape and together forming a mounting hole receiving the battery post, said clamp and said arms cooperatively mechanically coupling said component with the battery post.

16. The method of claim 15, further comprising the step of pivoting a swing clamp to a clamped position after said mounting hole receives the battery post, wherein said clamp is said swing clamp, said swing clamp including two opposing ends and each said arm including a third wall extending from a corresponding said second wall, said third walls respectively forming terminating ends of said component, said third walls being substantially parallel relative to one another, each said third wall defining a hole therein, each said hole receiving a respective said end of said swing clamp.

* * * * *

UNITED STATES PATENT AND TRADEMARK OFFICE

CERTIFICATE OF CORRECTION

PATENT NO. : 7,614,921 B2
APPLICATION NO. : 12/115144
DATED : November 10, 2009
INVENTOR(S) : Ken Sikora It is certified that error appears in the above-identified patent and that said Letters Patent is hereby corrected as shown below:

COLUMN 5
At line 16, please delete "250".

Signed and Sealed this

Twenty-third Day of March, 2010

David J. Kappos

David J. Kappos
*Director of the United States Patent and Trademark Office*